US006555975B2

(12) United States Patent
Satou et al.

(10) Patent No.: US 6,555,975 B2
(45) Date of Patent: Apr. 29, 2003

(54) CATHODE-RAY TUBE APPARATUS

(75) Inventors: Kazunori Satou, Fukaya (JP); Tomonari Ishihara, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 1 day.

(21) Appl. No.: 09/892,698

(22) Filed: Jun. 28, 2001

(65) Prior Publication Data

US 2002/0047508 A1 Apr. 25, 2002

(30) Foreign Application Priority Data

Jun. 29, 2000 (JP) ..... 2000-195897
Apr. 18, 2001 (JP) ..... 2001-119664

(51) Int. Cl.[7] ..... H01J 29/70; H01J 29/51
(52) U.S. Cl. ..... 315/364; 315/368.15; 313/414
(58) Field of Search ..... 315/364, 366, 315/368.15, 382, 94, 95, 98, 105, 399; 313/414, 449, 440; H01J 29/70, 29/51

(56) References Cited

U.S. PATENT DOCUMENTS 5,061,881 A * 10/1991 Suzuki et al. ..... 313/414
5,281,896 A * 1/1994 Albright ..... 313/610
5,734,235 A * 3/1998 Noguchi ..... 313/414
5,990,637 A * 11/1999 Cho ..... 313/414
6,166,483 A * 12/2000 Chen et al. ..... 313/409
6,335,597 B1 * 1/2002 Ueno et al. ..... 313/412
6,339,293 B1 * 1/2002 Kimiya et al. ..... 313/421

FOREIGN PATENT DOCUMENTS

JP 61-99249 5/1986

* cited by examiner

*Primary Examiner*—Don Wong
*Assistant Examiner*—Trinh Vo Dinh
(74) *Attorney, Agent, or Firm*—Oblon, Spivak, McClelland, Maier & Neustadt, P.C.

(57) ABSTRACT

A main lens includes a second segment, a sixth grid and an additional electrode disposed between the second segment and the sixth grid. A first-level constant voltage and a second-level constant voltage are applied to the second segment and sixth grid, respectively. A third-level voltage, which is at a level between the first level and the second level, is applied to the additional electrode. In accordance with the increase in a deflection amount of an electric beam, the third-level voltage varies as a value expressed by ((voltage to the additional electrode)−(voltage to the second segment))/((voltage to the sixth grid)−(voltage to the second segment)). An auxiliary lens having lenses including a third grid and a first segment has a focusing power decreasing in accordance with an increase in the deflection amount of the electron beam.

14 Claims, 4 Drawing Sheets

CATHODE-RAY TUBE APPARATUS

CROSS-REFERENCE TO RELATED APPLICATIONS

This application is based upon and claims the benefit of priority from the prior Japanese Patent Applications No. 2000-195897, filed Jun. 29, 2000; and No. 2001-119664, filed Apr. 18, 2001, the entire contents of both of which are incorporated herein by reference.

BACKGROUND OF THE INVENTION

The present invention relates generally to a cathode-ray tube apparatus and more particularly to a color cathode-ray tube apparatus capable of improving an oval distortion of a beam spot shape on a peripheral portion of a phosphor screen and stably providing a high image quality.

A currently dominant self-convergence type inline color cathode-ray tube apparatus comprises an inline electron gun assembly for emitting three in-line electron beams, which travel on a horizontal plane, and a deflection yoke for generating non-uniform deflection magnetic fields for deflecting the electron beams emitted from the electron gun assembly. The deflection magnetic fields comprise a pin-cushion-shaped horizontal deflection magnetic field and a barrel-shaped vertical deflection field. As the degree of deflection of the electron beams increases, the deflection magnetic fields will have a stronger action as an equivalent quadrupole lens for vertically focusing the electron beams and horizontally diverging the electron beams.

The distance between the electron gun assembly and the phosphor screen increases as the location of deflected electron beams shifts from a central portion to a peripheral portion of the phosphor screen. Owing to the difference in this distance, while the electron beams are focused at the central portion of the phosphor screen, the electron beams are defocused at the peripheral portion of the phosphor screen.

Accordingly, the beam spot at the peripheral portion of the phosphor screen is optimally focused in the horizontal direction by virtue of mutual cancellation of the diverging action of the deflection magnetic field and the defocusing due to the difference in distance. However, the beam spot at the peripheral portion of the phosphor screen is over-focused in the vertical direction by the addition of the focusing action of the deflection magnetic field and the defocusing due to the difference in distance. Consequently, the beam spot formed on the central portion of the phosphor screen is substantially circular, while the beam spot formed on the peripheral portion of the phosphor screen includes a horizontally elongated high-luminance portion (core) and a vertically elongated low-luminance portion (halo). Because of this, the resolution at the peripheral portion of the phosphor screen considerably deteriorates.

To solve this problem, Jpn. Pat. Appln. KOKAI Publication No. 61-99249 discloses a DAF (Dynamic Astigmatism and Focus) electron gun assembly. This electron gun assembly is characterized in that a third grid, which functions as a focus electrode, comprises a first segment G3-1 and a second segment G3-2. An electron beam passage hole formed at the second segment (G3-2) side surface of the first segment G3-1 has a vertically elongated shape. An electron beam passage hole formed at the first segment (G3-1) side surface of the second segment G3-2 has a horizontally elongated shape. In addition, a dynamic voltage, which is obtained by superimposition of an AC component varying parabolically in accordance with a variation in the degree of deflection of electron beams, is applied to the second segment G3-2.

Thus, in accordance with the deflection of the electron beams, a potential difference occurs between the first segment and the second segment. This potential difference creates a quadrupole lens between the first segment and second segment, which horizontally focus the electron beams and vertically diverges the electron beams. The quadrupole lens compensates a deflection aberration occurring due to the deflection of electron beams. In addition, since the second segment is supplied with the dynamic voltage, the focusing action of the main lens is weakened in accordance with the increase in the deflection amount of the electron beams. Thus, the defocusing due to the aforementioned difference in distance is also corrected.

The electron gun assembly, however, has two problems: 1) as the degree of deflection of electron beams increases, the distance between the electron gun assembly and the phosphor screen increases and the beam spot size increases accordingly, and 2) as the degree of deflection of electron beams increases, the beam spot formed on the phosphor screen is horizontally deformed. Owing to these two problems, the beam spot formed at the peripheral portion of the phosphor screen has an increased average size and a deformed shape.

An explanation will now be given of the phenomenon occurring with this electron gun assembly, in which the beam spot size increases at the peripheral portion of the phosphor screen.

FIGS. 8A and 8B show simplified models for explanation based on only the distance between the electron gun assembly and the phosphor screen, and the power of the main lens. Thus, FIGS. 8A and 8B omit illustration of the quadrupole lens component created by the deflection magnetic fields and the quadrupole lens formed in the electron gun assembly.

The size of the beam spot on the phosphor screen depends on a magnification M expressed by the ratio of a divergence angle $\alpha o$ of an electron beam emitted from an electron beam generating section of the electron gun assembly to an incidence angle $\alpha i$ on the phosphor screen. Thus, the magnification M is given by M=(divergence angle $\alpha o$/incidence angle $\alpha i$).

As is shown in FIG. 8A, in a case where an electron beam is focused on a central portion of the phosphor screen, the electron beam emitted from an object point O at divergence angles $\alpha o$ in both horizontal and vertical directions is focused by a main lens 20 and made incident on the phosphor screen with incidence angles $\alpha i(1)$ in both the horizontal and vertical directions. A magnification M(1) in this case is expressed by $M(1)=\alpha o/\alpha i(1)$.

As is shown in FIG. 8B, when the electron beam is focused on a peripheral portion of the phosphor screen, the distance between the electron gun assembly and the phosphor screen increases. The electron beam emitted from the object point O at divergence angles $\alpha o$ in both horizontal and vertical directions is focused by the main lens. In the electron gun assembly disclosed in Jpn. Pat. Appln. KOKAI Publication No. 61-99249, the focal distance is increased by weakening the focusing power of the main lens. The electron beam focused by the main lens is made incident on the phosphor screen with incidence angles $\alpha i(2)$ in both the horizontal and vertical directions. A magnification M(2) in this case is expressed by $M(2)=\alpha o/\alpha i(2)$.

Since the distance between the object point O and the main lens is constant, the magnification $\alpha i(2)$ decreases as the distance (focal distance) between the main lens and the phosphor screen increases. Since $\alpha i(1)>\alpha i(2)$, $M(1)<M(2)$.

When the focal distance is varied by the main lens power, the magnification M increases and the beam spot size on the phosphor screen increases in accordance with the increase in the focal distance. Thus, in the case of the electron gun assembly disclosed in Jpn. Pat. Appln. KOKAI Publication No. 61-99249, the average spot size of the beam spot formed on the peripheral portion of the phosphor screen is larger than that of the beam spot formed on the central portion of the phosphor screen.

An explanation will now be given of the phenomenon in which the electron beam spot on the peripheral portion of the phosphor screen is horizontally deformed, using an optical lens model as well. A horizontal magnification Mx of the electron beam and a vertical magnification My of the electron beam are expressed by Mx (horizontal magnification)=$\alpha ox$ (horizontal divergence angle)/$\alpha ix$ (horizontal incidence angle), and My (vertical magnification)=$\alpha oy$ (vertical divergence angle)/$\alpha iy$ (vertical incidence angle).

When the electron beam is not deflected, as shown in FIG. 8A, the electron beam emitted from the object point O with the divergence angles $\alpha o$ in the horizontal direction x and vertical direction Y is focused by the main lens 20 with no astigmatism. The beam is then made incident on the phosphor screen with the incidence angles $\alpha i$ (1) in the horizontal direction X and vertical direction Y. In this case, the horizontal magnification Mx is equal to the vertical magnification My, and a circular beam spot is formed.

On the other hand, when the electron beam is deflected, as shown in FIG. 8C, a quadrupole lens component 30 created by the deflection magnetic fields and a quadrupole lens 21 for correcting the lens component 30 are newly added. The electron beam emitted from the object point O with the divergence angles $\alpha o$ in the horizontal direction X and vertical direction Y travels through the quadrupole lens 21, main lens 20 and quadrupole lens component 30 created by the deflection magnetic fields. The beam is thus made incident on the phosphor screen with an incidence angle $\alpha ix(3)$ in the horizontal direction X and an incidence angle $\alpha iy(3)$ in the vertical direction. In this case, a horizontal magnification Mx(3) of the electron beam and a vertical magnification My(3) of the electron beam are expressed by $Mx(3)=\alpha o/\alpha ix(3)$, and $My(3)=\alpha o/\alpha iy(3)$.

As is clear from FIG. 8C, $\alpha ix(3)<\alpha iy(3)$. Thus, the relationship between the horizontal magnification Mx(3) and vertical magnification My(3) is given by $Mx(3)>My(3)$. Accordingly, the beam spot formed at the peripheral portion of the phosphor screen is horizontally elongated.

This problem occurs because the astigmatism caused by the deflection magnetic fields is compensated by the quadrupole lens located away from the deflection magnetic fields. In order to suppress horizontal elongation of the beam spot on the peripheral portion of the phosphor screen, it is necessary to decrease the distance between the magnetic fields and the quadrupole lens that compensates the astigmatism caused by the deflection magnetic fields.

As has been stated above, in order to enhance the image quality of the cathode-ray tube apparatus, it is imperative that the beam spot have a uniform shape over the entire surface of the phosphor screen. It is thus necessary to simultaneously compensate, as the degree of deflection of electron beams increases, the defocusing due to the increase in distance between the electron gun assembly and the phosphor screen and the astigmatism due to the deflection magnetic fields.

In the typical prior-art electron gun assembly as disclosed in Jpn. Pat. Appln. KOKAI Publication No. 61-99249, a proper parabolic dynamic voltage is applied to the low-voltage side electrode of the main lens to vary the main lens power, thereby correcting the defocusing. At the same time, by forming a dynamically varying quadrupole lens, the astigmatism due to deflection magnetic fields is corrected.

However, if the beam spot on the central portion of the phosphor screen is made substantially circular, the beam spot shape on the peripheral portion of the phosphor screen would be considerably horizontally elongated and the average size of the beam spot would increase.

The horizontal elongation of the beam spot on the peripheral portion of the phosphor screen occurs for the following reason. If the astigmatism of deflection magnetic fields is to be compensated by the quadrupole lens located on the cathode-side of the main lens, there is a distance between the quadrupole lens component due to the deflection magnetic fields and the quadrupole lens within the electron gun assembly. This distance increases the difference between the horizontal magnification Mx and vertical magnification My. Thus, the beam spot is horizontally elongated.

Besides, since the defocusing occurring when the electron beam is deflected towards the peripheral portion of the phosphor screen is compensated by varying the main lens power, the magnification at the peripheral portion of the phosphor screen becomes greater than that at the central portion of the phosphor screen. As a result, the average size of the beam spot at the peripheral portion of the phosphor screen increases.

BRIEF SUMMARY OF THE INVENTION

The present invention has been made in consideration of the above problems, and its object is to provide a cathode-ray tube apparatus capable of forming a beam spot with a uniform shape over the entire surface of a phosphor screen.

The present invention provides a cathode-ray tube apparatus comprising:

an electron gun assembly having an electron beam generating unit for generating an electron beam, at least one auxiliary lens for prefocusing the electron beam generated from the electron beam generating unit, and a main lens for focusing the electron beam prefocused by the auxiliary lens on a phosphor screen; and a deflection yoke for generating deflection magnetic fields for horizontally and vertically deflecting the electron beam emitted from the electron gun assembly, wherein the electron gun assembly comprises a focus electrode, at least one additional electrode and an anode, which are arranged in a direction of travel of the electron beam and constitute the main lens, and also comprises a voltage applying means for applying predetermined voltages to the respective electrodes constituting the main lens, the voltage applying means applies a constant focus voltage to the focus electrode, a constant anode voltage, which is higher than the focus voltage, to the anode, and a voltage, which is higher than the focus voltage and lower than the anode voltage and varies in accordance with deflection of the electrode beam, to the additional electrode, the main lens varies such that a vertical focusing power becomes lower than a horizontal focusing power in accordance with an increase in deflection amount of the electron beam, and the at least one auxiliary lens has a focusing power decreasing in accordance with an increase in deflection amount of the electron beam.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of a cathode-ray tube apparatus according to the present invention will now be described with reference to the accompanying drawings.

Figure 3:
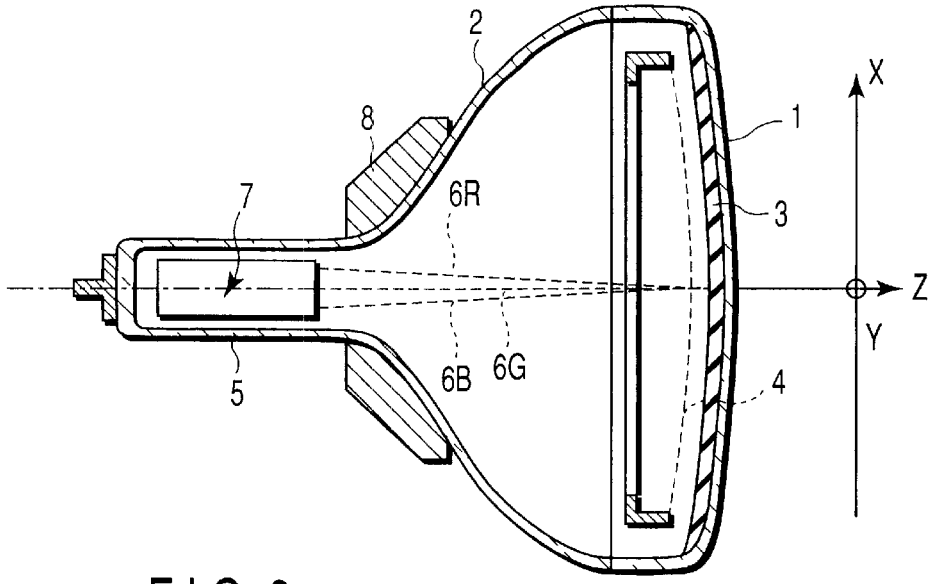
FIG. 3 is a horizontal cross-sectional view schematically showing the structure of a color cathode-ray tube apparatus according to an embodiment of the cathode-ray tube apparatus according to the present invention.

As is shown in FIG. 3, the cathode-ray tube apparatus of the present invention, for example, an in-line color cathode-ray tube apparatus, has an envelope comprising a panel 1, a neck 5 and a funnel 2 integrally coupled to the panel 1 and neck 5. The panel 1 has a phosphor screen 3 on its inner surface. The phosphor screen 3 comprises stripe-shaped or dot-shaped three-color phosphor layers that emit blue, green and red light. A shadow mask 4, which has many electron beam passage holes therein, is disposed to face the phosphor screen 3.

An in-line electron gun assembly 7 is included in the neck 5. The electron gun assembly 7 emits three electron beams 6B, 6G and 6R arranged in line, i.e. a center beam 6G and a pair of side beams 6B and 6R passing in the same horizontal plane.

A deflection yoke 8 is mounted on that portion of the funnel 2, which extends between a large-diameter portion of the funnel 2 and the neck 5. The deflection yoke 8 generates non-uniform deflection magnetic fields for deflecting the three electron beams 6B, 6G and 6R from the electron gun assembly 7 in a horizontal direction (X) and a vertical direction (Y). The non-uniform deflection magnetic fields comprise a pin-cushion-shaped horizontal deflection magnetic field and barrel-shaped vertical deflection magnetic field.

The three electron beams 6B, 6G and 6R emitted from the electron gun assembly 7 are deflected by the non-uniform magnetic fields generated by the deflection yoke 8 and caused to scan the phosphor screen 3 via the shadow mask 4 in the horizontal direction X and vertical direction Y. Thereby, a color image is displayed.

Figure 1:
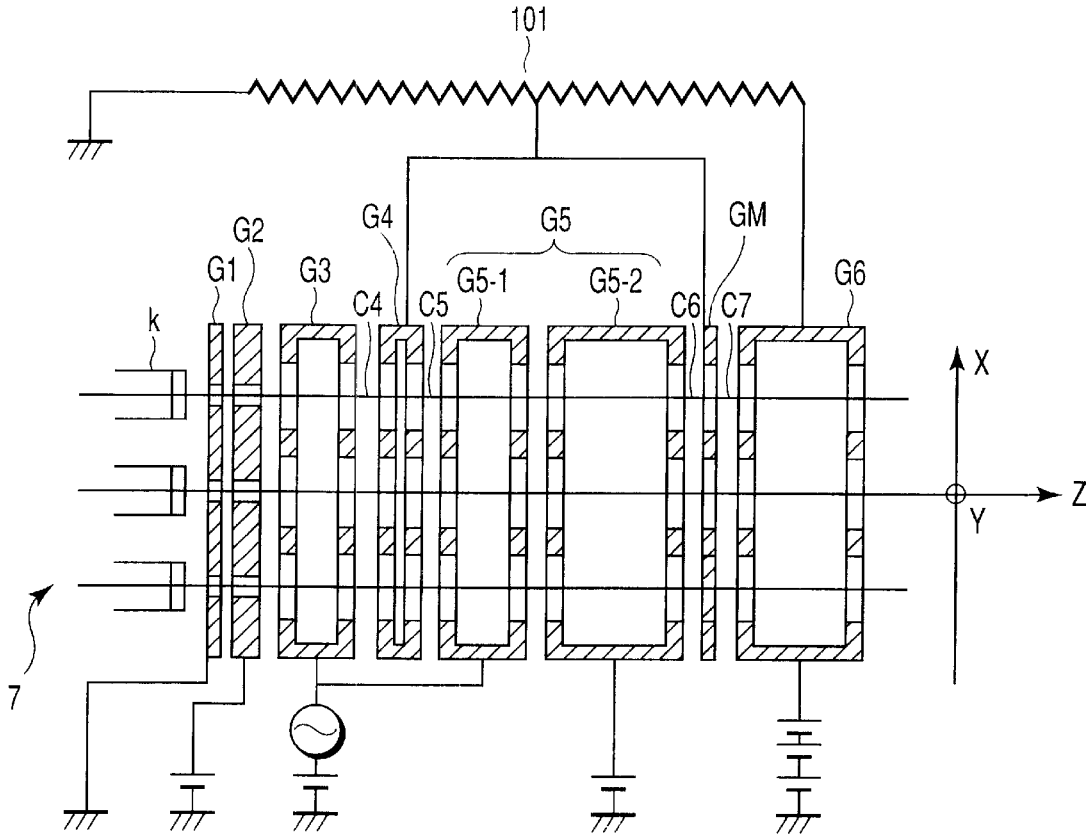
FIG. 1 is a horizontal cross-sectional view schematically showing an example of the structure of an electron gun assembly applied to a cathode-ray tube apparatus according to the present invention.

As is shown in FIG. 1, the electron gun assembly 7 comprises three cathodes K arranged in line in the horizontal direction X, three heaters (not shown) for individually heating the cathodes K, and six electrodes. The six electrodes, that is, a first grid G1, a second grid G2, a third grid G3, a fourth grid G4, a fifth grid G5 (focus electrode) and a sixth grid G6 (anode), are arranged in the named order from the cathode K side toward the phosphor screen.

The fifth grid G5 comprises a first segment G5-1 disposed on the cathode K side and a second segment G5-2 disposed on the phosphor screen side. The electron gun assembly 7 has an additional electrode GM that is disposed at a geometrical center between the second segment G5-2 of fifth grid G5 and the sixth grid G6, that is, at an equidistant position from the second segment G5-2 and the sixth grid G6. The heaters, cathodes K and the electrodes are integrally fixed by a pair of insulating support members (not shown).

The first and second grids G1 and G2 are composed of integral plate-like electrodes, respectively. Each of these plate-like electrodes has three in-line circular electron beam passage holes formed in the horizontal direction in association with the three cathodes K. The third grid G3 and fourth grid G4 are composed of integral cylindrical electrodes. Each of these cylindrical electrodes has, in its both end faces, three in-line circular electron beam passage holes formed in the horizontal direction in association with the three cathodes K. The first and second segments G5-1 and G5-2 of the fifth grid G5 and the sixth grid G6 are composed of integral cylindrical electrodes. Each of these cylindrical electrodes has, in its both end faces, three in-line circular electron beam passage holes formed in the horizontal direction in association with the three cathodes K.

Figure 2A:
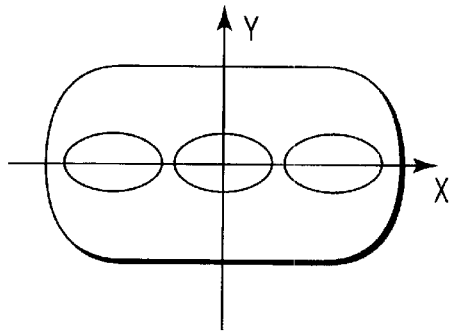
FIG. 2A is a front view schematically showing the structure of an additional electrode applied to the electron gun assembly shown in FIG. 1.
Figure 2B:
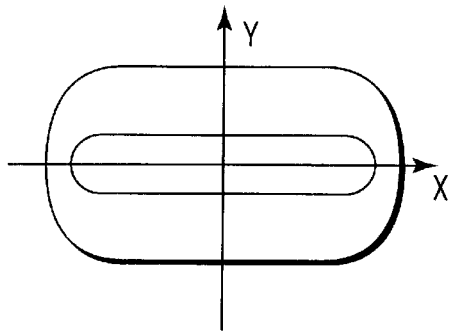
FIG. 2B is a front view schematically showing the structure of another additional electrode applicable to the electron gun assembly shown in FIG. 1.

As is shown in FIG. 2A, the additional electrode GM has three in-line non-circular electron beam passage holes formed in the horizontal direction in association with the three cathodes K. Each of these non-circular electron beam passage holes has a major axis in the horizontal direction X. Alternatively, as shown in FIG. 2B, the additional electrode GM has a single non-circuit electron beam passage hole having a major axis in the horizontal direction X. This single non-circular electron beam passage hole is shared by the three electron beams.

In the electron gun structure 7 having the above structure, a voltage obtained by superimposing video signals upon a DC voltage of about 150 V is applied to the cathodes K. The first grid G1 is grounded. A DC voltage of about 600 V is applied to the second grid G2. A fixed voltage in the range of about 6 kV to about 10 kV is applied to the second segment G5-2 of the fifth grid G5, irrespective of the amount of deflection of electron beams. A fixed anode voltage in the range of about 25 kV to about 35 kV is applied to the sixth grid G6, irrespective of the amount of deflection of electron beams.

The third grid G3 is electrically connected to the first segment G5-1 of fifth grid G5 within the tube. A dynamic voltage, which is obtained by superimposing a parabolically variable AC voltage component upon a predetermined DC voltage, is applied to the third grid G3. The AC voltage component is synchronized with a sawtooth deflection current supplied to the deflection yoke and increases in a parabolic fashion in accordance with an increase in the amount of deflection of electron beams.

The dynamic voltage takes a minimum value in a non-deflection mode in which electron beams are focused on a central portion of the phosphor screen. The dynamic voltage takes a maximum value when the electron beams are deflected onto a corner portion of the phosphor screen. In the non-deflection mode, the dynamic voltage is lower than the voltage applied to the second segment G5-2 of fifth grid G5. Even when the electron beams are deflected onto the corner portion of the phosphor screen, the dynamic voltage does not exceed the voltage applied to the second segment G5-2.

As is shown in FIG. 1, the fourth grid G4 is electrically connected to the additional electrode GM within the tube. A voltage, which is obtained by dividing an anode voltage applied to the sixth grid G6 by means of a voltage-dividing resistor 101 disposed along the electron gun assembly 7, is applied to the fourth grid G4 and additional electrode GM. The voltage applied to each of the fourth grid G4 and additional electrode GM is higher than the voltage (focus voltage) applied to the second segment G5-2 and lower than the voltage (anode voltage) applied to the sixth grid G6. The voltage applied to each of the fourth grid G4 and additional electrode GM is set at an intermediate potential between the focus voltage and anode voltage.

With the application of the voltages to the respective grids, the electron gun structure 7 forms an electron beam generating unit, a prefocus lens, a first auxiliary lens, a second auxiliary lens, and a main lens.

The electron beam generating unit is constituted by the cathodes K, first grid G1 and second grid G2. The electron beam generating unit generates electron beams and forms an object point for the main lens. The prefocus lens is constituted by the second grid G2 and the third grid G3 and it prefocuses the electron beams generated from the electron beam generating unit.

The first auxiliary lens is formed by the third grid G3 (first electrode), fourth grid G4 (second electrode) and first segment G5-1 (third electrode) of fifth grid G5. The first auxiliary lens further prefocuses the electron beams which have been prefocused by the prefocus lens. The second auxiliary lens is formed by the first segment G5-1 and second segment G5-2 of the fifth grid G5. The second auxiliary lens further focuses the electron beams that have been prefocused by the first auxiliary lens.

The main lens is formed by the second segment G5-2 (focus electrode) of fifth grid G5, additional electrode GM and sixth grid (anode). The main lens ultimately focuses the electron beams on the phosphor screen. At the time of non-deflection, since the additional electrode GM is disposed at a geometrical center of the main lens and is supplied with the intermediate voltage between the voltage applied to the second segment G5-2 and the voltage applied to the sixth grid G6, a BPF main lens with no astigmatism is formed. At the time of deflection, a quadrupole lens is formed within the main lens by the additional electrode GM disposed between the second segment G5-2 and sixth grid G6.

A lens action at the time of non-deflection will now be described using an optical model.

Figure 6A:
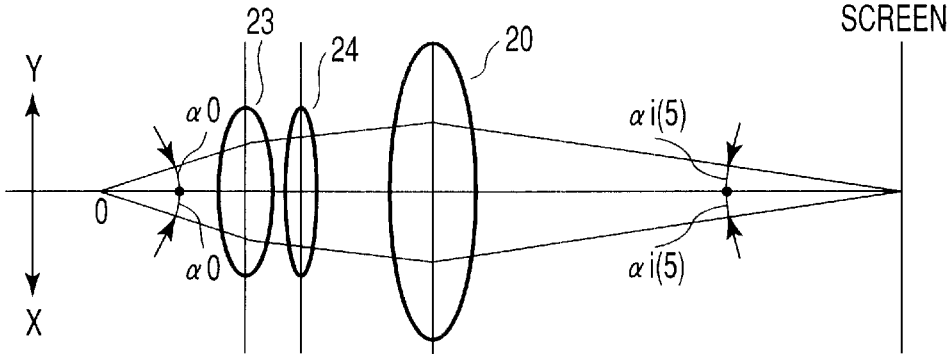
FIG. 6A shows an optical lens model for describing a lens action in a non-deflection mode in which an electron beam is focused on a central portion of the phosphor screen in the electron gun assembly shown in FIG. 1.

In FIG. 6A, a first auxiliary lens 23 and a second auxiliary lens 24 are formed in front of the main lens 20. The first and second auxiliary lenses 23 and 24 have focusing functions in the horizontal direction X and vertical direction Y. An electron beam emitted from the object point O at a divergence angle $\alpha o$ in the horizontal direction X and vertical direction Y is prefocused by the first auxiliary lens 23 and second auxiliary lens 24. The prefocused electron beam is focused by the main lens 20. The electron beam is then made incident on the phosphor screen at an incidence angle $\alpha i$ (5) in the horizontal direction X and vertical direction Y. A magnification M(5) at this time is expressed by $M(5)=\alpha o/\alpha i$ (5). In this case, since symmetry is established in the horizontal direction X and vertical direction Y, the beam spot of the electron beam focused on a central portion of the phosphor screen has an equal diameter in the horizontal direction x and vertical direction Y and has a substantially circular shape.

A description will now be given of defocusing compensation in a case where the distance between the electron gun assembly and phosphor screen is increased in the deflection mode.

When the electron beam is deflected onto a peripheral portion of the phosphor screen, a dynamic voltage varying in accordance with a variation in deflection amount of the electron beam is applied to the third grid G3 and the first segment G5-1 of fifth grid G5. A voltage higher than the voltage to the third grid G3 is applied to the fourth grid G4 through the voltage-dividing resistor 101. A parabolic AC component is induced in the fourth grid G4 by a capacitance between the third grid G3 and first segment G5-1. An induction voltage at this time will now be found.

Assume that a capacitance between the third grid G3 and fourth grid G4 is C4, and a capacitance between the fourth grid G4 and first segment G5-1 is C5. Since the fourth grid G4 is electrically connected to the additional electrode GM, the induction voltage induced in the fourth grid G4 is affected by a capacitance C6 between the second segment G5-2 and additional electrode GM and a capacitance C7 between the additional electrode GM and sixth grid G6.

When a dynamic voltage Vd is applied to the third grid G3 and first segment G5-1, an induction voltage V4 induced in the fourth grid G4 is expressed by $V4=(C4+C5)/(C4+C5+C6+C7)\times Vd$. If $C4=C5=C6=C7$, $V4=Vd/2$. Accordingly, half the dynamic voltage Vd is induced in the fourth grid G4. The dynamic voltage Vd is applied to the third grid G3 and first segment G5-1, and the potential difference between the third grid G3 and first segment G5-1, on the one hand, and the fourth grid G4, on the other hand, decreases as the amount of deflection of the electron beam increases. Consequently, as the amount of deflection of the electron beam increases, the lens power of the first auxiliary lens 23 formed by the third grid G3, fourth grid G4 and first segment G5-1 decreases. In other words, the focusing power of the first auxiliary lens 23 in the horizontal direction X and vertical direction Y decreases as the amount of deflection of the electron beam increases.

On the other hand, the dynamic voltage vd is applied to the first segment G5-1, and the potential difference between the first segment G5-1 and second segment G5-2 decreases as the amount of deflection of the electron beam increases. Thus, as the amount of deflection of the electron beam increases, the lens power of the second auxiliary lens 24 formed by the first segment G5-1 and second segment G5-2 decreases. In other words, the focusing power of the second auxiliary lens 24 in the horizontal direction X and vertical direction Y decreases as the amount of deflection of the electron beam increases.

Figure 6B:
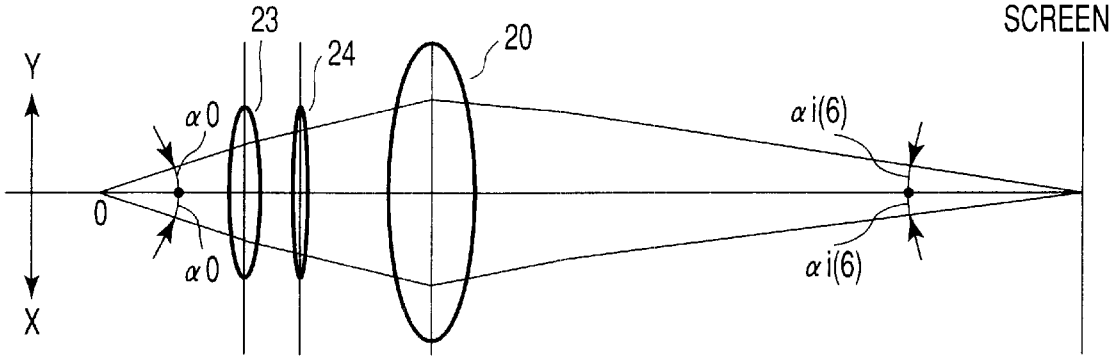
FIG. 6B shows an optical lens model for describing a lens action in a case where the distance between the electron gun assembly and the phosphor screen is made greater than in the non-deflection mode.

This defocusing compensation will now be described using an optical model shown in FIG. 6B. In FIG. 6B, compared to FIG. 6A, the distance between the electron gun assembly and the phosphor screen is increased. This electron gun assembly is characterized in that defocusing due to the increase in distance between the electron gun assembly and the phosphor screen is compensated by varying the lens powers of the first auxiliary lens 23 and second auxiliary lens 24 disposed on the cathode side of the main lens 20.

An electron beam emitted from the object point O at a divergence angle $\alpha o$ in the horizontal direction X and vertical direction Y is prefocused by the first auxiliary lens 23 and second auxiliary lens 24. The lens power of each of the two auxiliary lenses 23 and 24 is weaker than in the case of the non-deflection mode illustrated in FIG. 6A. Since the lens power of each of the two auxiliary lenses 23 and 24 lessens, the diameter of the electron beam incident on the main lens 20 increases, compared to the case illustrated in FIG. 6A. Since the lens power of the main lens 20 is constant, if the distance between the electron gun assembly and phosphor screen increases, the electron beam strikes the phosphor screen at an incidence angle $\alpha i$ (6) in the horizontal direction X and vertical direction Y. A magnification M(6) at this time is expressed by $M(6)=\alpha o/\alpha i$ (6). Since the incidence angle $\alpha i$ (6) of the electron beam on the phosphor screen can be made substantially equal to the incidence angle $\alpha i$ (5) of the electron beam on the phosphor screen in the case shown in FIG. 6A, the magnification M(6) in the deflection mode is substantially equal to the magnification M(5) in the non-deflection mode.

It is thus possible to substantially prevent degradation in lens magnification due to the increase in the distance between the electron gun assembly and the phosphor screen.

A method of creating a quadrupole lens within the main lens will now be described.

Figure 4A:
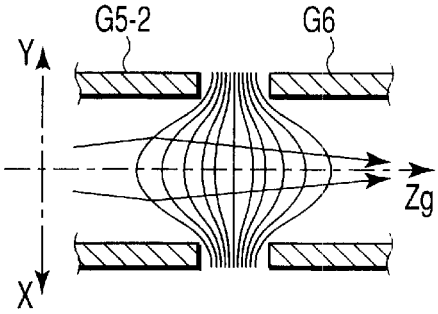
FIG. 4A shows a horizontal/vertical cross section of a rotation-symmetrical bi-potential lens and an equipotential surface.
Figure 4B:
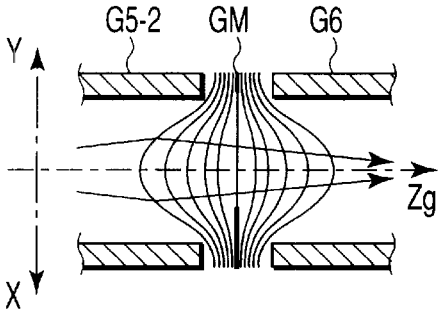
FIG. 4B shows a horizontal/vertical cross section of a rotation-symmetrical bi-potential lens and an equipotential surface, in a case where an additional electrode is inserted in the rotation-symmetrical bi-potential lens and no quadrupole lens functions.

In the non-deflection mode, the main lens comprising the second segment G5-2, additional electrode GM and sixth grid G6 is formed by an electric field as shown in FIG. 4B. The electric field shown in FIG. 4B is substantially the same as an electric field of the main lens comprising the second segment G5-2 and sixth grid G6, as shown in FIG. 4A.

Figure 7:
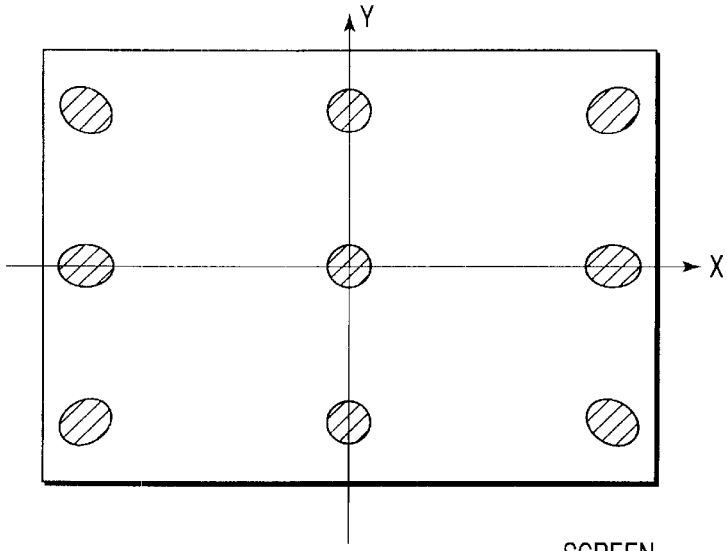
FIG. 7 shows examples of beam spots formed on the phosphor screen of the cathode-ray tube apparatus according to the present invention.
Figure 8A:
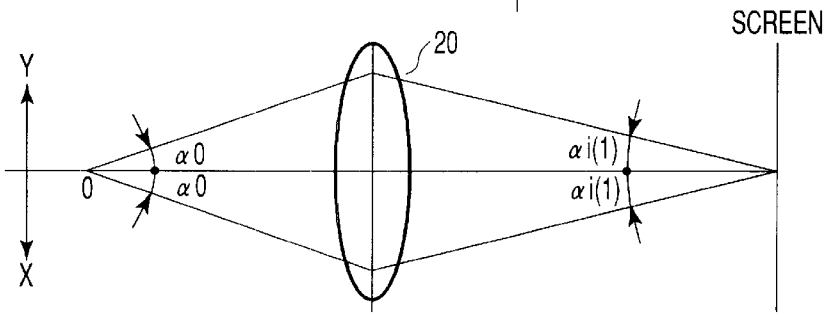
FIG. 8A shows an optical lens model for describing a lens action in a non-deflection mode in a prior-art electron gun.
Figure 8B:
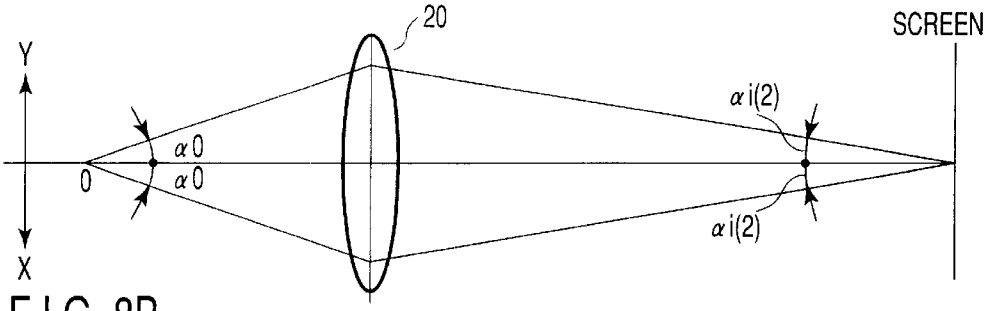
FIG. 8B shows an optical lens model for describing a lens action in a case where the distance between the electron gun assembly and the phosphor screen is made greater than in the non-deflection mode.
Figure 8C:
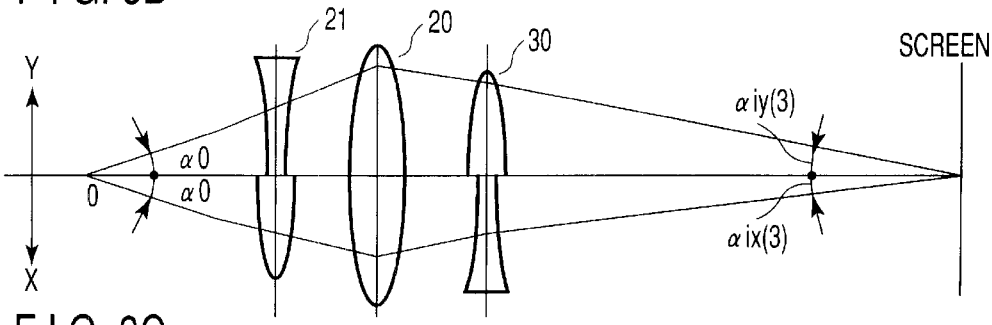
FIG. 8C shows an optical lens model for describing a lens action in a deflection mode.

Specifically, the additional electrode GM is disposed at a geometrical center between the second segment G5-2 and sixth grid G6 and is supplied with the intermediate voltage between the focus voltage applied to the second segment G5-2 and the anode voltage applied to the sixth grid G6. Thus, equilibrium is kept between the electron lens formed between the additional electrode GM and second segment G5-2 and the electron lens formed between the additional electrode GM and sixth grid G6. In this state, the shape of the electron beam passage hole in the additional electrode GM does not affect the electric field that creates the main lens. Accordingly, a quadrupole lens is not formed within the main lens and the magnification of the main lens is equal in the horizontal direction X and vertical direction Y. As shown in FIG. 7, a substantially circular beam spot is formed at the central portion of the phosphor screen.

In the deflection mode, the electron beam is deflected onto the peripheral portion of the phosphor screen. In this case, the aforementioned voltage Vd/2, which is half the dynamic voltage Vd, is induced in the fourth grid G4. Of course, the voltage Vd/2, which is half the dynamic voltage Vd, is also induced in the additional electrode GM connected to the fourth grid G4. On the other hand, constant voltages are always applied to the second segment G5-2 and sixth grid G6. In the non-deflection mode, if the voltage to the additional electrode GM is EcM1, the voltage to the second segment G5-2 is Ec52 and the voltage to the sixth grid G6 is Ec6, the following relationship is established:

$EcM1=(Ec52+Ec6)/2$ When the additional electrode voltage EcM1 takes this value, no quadrupole lens is formed within the main lens, whatever shape the electron beam passage hole in the additional electrode GM has.

In the deflection mode, if the additional electrode voltage is EcM2 and the applied dynamic voltage is Vd, the following relationship is established:

$EcM2=EcM1+Vd/2=(Ec52+Ec6)/2+Vd/2$ Thereby, equilibrium is lost between the potential difference between the second segment G5-2 and additional electrode GM and the potential difference between the additional electrode GM and sixth grid G6, and a quadrupole lens can be formed within the main lens.

In the present embodiment, in accordance with the increase in the deflection amount of the electron beam, the voltage induced in the additional electrode GM increases and the potential difference between the additional electrode GM and sixth grid G6 decreases. In other words, in accordance with the increase in the deflection amount of the electron beam, the difference in voltage between the second segment G5-2 and additional electrode GM becomes greater than the difference in voltage between the additional electrode GM and sixth grid G6.

Figure 5:
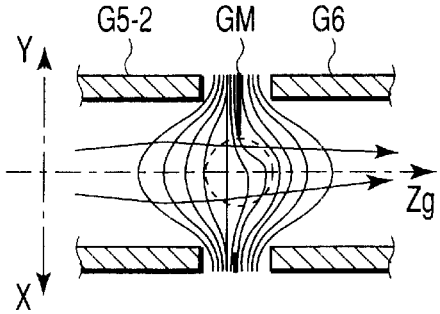
FIG. 5 shows a horizontal/vertical cross section and an equipotential surface, in a case where a quadrupole lens in the main lens in the electron gun assembly shown in FIG. 1 is made to function.

As a result, the potential between the second segment G5-2 and additional electrode GM permeates through the electron beam passage hole in the additional electrode GM into the sixth grid G6. When the electron beam passage hole in the additional electrode GM has a horizontally elongated shape, as shown in FIG. 2A or 2B, a quadrupole lens having a focusing action in the horizontal direction X and a diverging action in the vertical direction Y can be created within the main lens, as shown in FIG. 5. Thereby, the lens action of the main lens varies so that the focusing power in the vertical direction Y may become less than the focusing power in the horizontal direction X in accordance with the increase in the deflection amount of the electron beam.

Figure 6C:
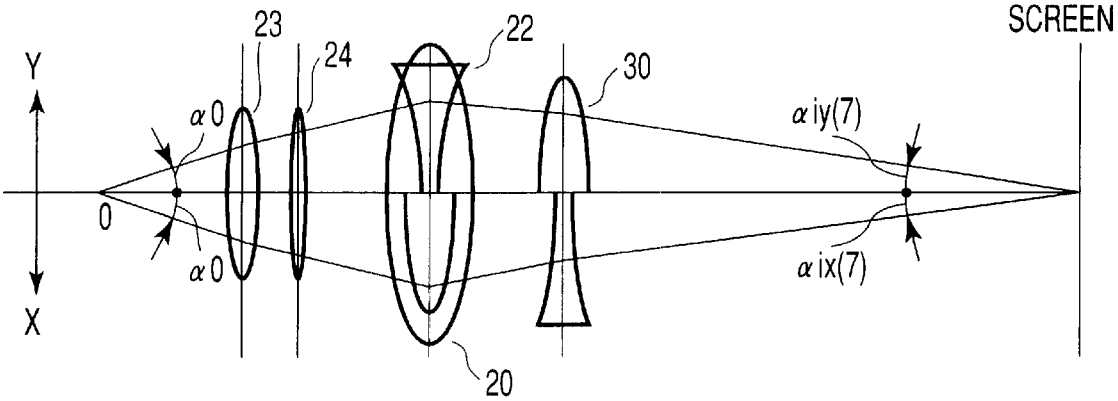
FIG. 6C shows an optical lens model for describing a lens action in a deflection mode in which an electron beam is deflected toward a peripheral portion of the phosphor screen.

This lens action will now be explained using an optical model as shown in FIG. 6C. In the deflection mode, a quadrupole lens 22 is formed within the main lens 20, and an astigmatism lens component 30 due to the deflection magnetic field can be compensated. An electron beam emitted from the object point O at a divergence angle $\alpha o$ in the horizontal direction X and vertical direction Y is prefocused by the first auxiliary lens 23 and second auxiliary lens 24, whose lens powers are made less than in the non-deflection mode illustrated in FIG. 6A. The prefocused electron beam is focused by the main lens 20 and travels through the quadrupole lens 22 in the main lens 20 and the lens component 30 due to the deflection magnetic field. The outgoing electron beam is then made incident on the phosphor screen at incidence angle $\alpha ix(7)$ and $\alpha iy(7)$ in the horizontal direction X and vertical direction Y. A magnification Mx(7) in the horizontal direction X and a magnification My(7) in the vertical direction Y are expressed by $Mx(7)=\alpha o/\alpha ix(7)$, and $My(7)=\alpha o/\alpha iy(7)$.

Although $\alpha ix(7)<\alpha iy(7)$, the difference between $\alpha ix(7)$ and $\alpha iy(7)$ is small since the distance between the quadrupole lens 22 formed in the main lens 20 and the astigmatism lens component 30 due to the deflection magnetic field is less than in the typical prior-art electron gun assembly disclosed in Jpn. Pat. Appln. KOKAI Publication No. 61-99249. Accordingly, the difference in magnification between the horizontal magnification Mx(7) and vertical magnification My(7) is reduced.

In the present electron gun assembly, as described above, the beam spot shape does not substantially deteriorate even if the distance between the electron gun structure and phosphor screen is increased. When this electron gun assembly is used, the shape of the beam spot formed on the peripheral portion of the phosphor screen can be made substantially circular, as shown in FIG. 7.

Therefore, it is possible to form a beam spot with a uniform shape over the entire surface of the phosphor screen and to enhance the quality of the displayed image.

The above-described cathode-ray tube apparatus has the electron gun assembly wherein the main lens is composed of the focus electrode (second segment G5-2 of fifth grid G5), anode (sixth grid G6) and at least one additional electrode (GM) disposed between the focus electrode and anode, these electrodes being arranged in the direction of travel of electron beams. The focus electrode and anode are supplied with constant focus voltage and anode voltage, independently of the deflection amount of electron beams.

The additional electrode is supplied with a voltage having a level between the focus voltage and anode voltage via the voltage-dividing resistor for dividing the anode voltage. Specifically, the additional electrode is supplied with such a voltage as to substantially equalize the potential distribution on the center axis of the electron beam passage hole to that of the bi-potential electron lens formed by the focus electrode and anode, in the non-deflection mode in which the electron beam is focused at the central portion of the phosphor screen. The additional electrode is disposed at a geometrical center of the main lens, that is, at an equidistant position from the focus electrode and anode. In the non-deflection mode, an intermediate voltage between the focus voltage and anode voltage is applied to the additional electrode. Thereby, even if the electron beam passage hole formed in the additional electrode has a non-circular shape, this shape causes no quadrupole lens effect. In this case, the main lens formed by the focus electrode, additional electrode and anode is substantially the same as the main lens formed by the two electrodes, i.e. the focus electrode and anode.

In the deflection mode in which the electron beam is deflected onto the peripheral portion of the phosphor screen, the additional electrode is supplied with such a voltage as to vary the following value in accordance with the increase in deflection amount of the electric beam:

((voltage to the additional electrode)—(voltage to the focus electrode))/((voltage to the anode)—(voltage to the focus electrode)).

At the same time, the focusing action of at least one auxiliary lens formed in front of the main lens is weakened in accordance with the increase in deflection amount of the electron beam.

More specifically, the first electrode (third grid G3), second electrode (fourth grid G4) and third electrode (first segment G5-1 of fifth grid G5) are arranged in the direction of travel of electron beams in front of the main lens, thereby forming the auxiliary lens. The additional electrode is electrically connected to the second electrode. The first electrode is electrically connected to the third electrode. The dynamic voltage varying in accordance with the deflection amount of electron beams is applied to the first and third electrodes. This dynamic voltage is a voltage parabolically increasing in accordance with the increase in deflection amount of electron beams.

This dynamic voltage induces a potential in the second electrode via the capacitance between the first and second electrodes and the capacitance between the second and third electrodes. Accordingly, a potential is induced in the additional electrode connected to the second electrode.

On the other hand, the potentials of the focus electrode and anode are invariable. Thus, if the potential is induced in the additional electrode, the potential difference between the focus electrode and additional electrode becomes greater than that between the additional electrode and anode. Consequently, in the main lens, the equilibrium state established in the non-deflection mode between the lens, which is formed between the focus electrode and additional electrode, and the lens, which is formed between the additional electrode and anode, is lost in the deflection mode. The lens power of the lens, which is formed between the focus electrode and additional electrode, surpasses the lens power of the lens, which is formed between the additional electrode and anode.

The focus electrode side potential of the additional electrode permeates into the anode side through the electron beam passage hole formed in the additional electrode. In this state, a quadrupole lens can be formed within the main lens in combination with the horizontally elongated non-circular electron beam passage hole formed in the additional electrode, which hole has a major axis in the in-line direction, that is, in the horizontal direction.

The quadrupole lens has a horizontal focus action and a vertical divergence action. Since the quadrupole lens is thus formed within the main lens, the total lens action of the main lens varies such that the vertical focusing power becomes less than the horizontal focusing power as the deflection amount of the electron beam increases.

Accordingly, the distance between the astigmatism lens component due to the deflection magnetic field and the quadrupole lens within the main lens is decreased, and the astigmatism lens component due to the deflection magnetic field is compensated by the quadrupole lens within the main lens that is closer to the deflection magnetic field. Therefore, the difference between the magnification of the electron beam in the horizontal direction and that of the electron beam in the vertical direction can be reduced. As a result, the horizontal deformation of the beam spot on the peripheral portion of the phosphor screen can be improved. Moreover, in the present method, half the dynamic voltage is induced in the additional electrode and this voltage creates the quadrupole lens. Thus, the sensitivity of the quadrupole lens can be enhanced.

Besides, defocusing due to the deflection of the electron beam onto the peripheral portion of the phosphor screen is controlled by varying the lens power of the auxiliary lens disposed on the cathode side of the main lens. Thus, degradation in magnification due to deflection can be suppressed.

Therefore, it is possible to form a beam spot with a uniform shape over the entire surface of the phosphor screen and to enhance the quality of the displayed image.

As has been described above, the present invention can provide a cathode-ray tube apparatus capable of forming a beam spot with a uniform shape over the entire surface of the phosphor screen.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode-ray tube apparatus comprising:

an electron gun assembly having an electron beam generating unit for generating an electron beam, at least one auxiliary lens for prefocusing the electron beam generated from the electron beam generating unit, and a main lens for focusing the electron beam prefocused by the auxiliary lens on a phosphor screen; and a deflection yoke for generating deflection magnetic fields for horizontally and vertically deflecting the electron beam emitted from the electron gun assembly, wherein the electron gun assembly comprises a focus electrode, at least one additional electrode and an anode, which are arranged in a direction of travel of the electron beam and constitute said main lens, and also comprises a voltage applying means for applying predetermined voltages to the respective electrodes constituting the main lens, the voltage applying means applies a constant focus voltage to the focus electrode, a constant anode voltage, which is higher than the focus voltage, to the anode, and a voltage, which is higher than the focus voltage and lower than the anode voltage and varies in accordance with a deflection of the electrode beam, to the additional electrode, the potential difference between the focus electrode and anode constituting the main lens is constant regardless of the deflection amount of the electron beam, and the main lens varies such that a vertical focusing power becomes lower than a horizontal focusing power in accordance with an increase in the deflection amount of the electron beam, and said at least one auxiliary lens has a focusing power decreasing in accordance with an increase in the deflection amount of the electron beam.

2. The cathode-ray tube apparatus according to claim 1, wherein each of the electrodes constituting the main lens has an electron beam passage hole for passing the electron beam, and the voltage applying means applies, in a non-deflection mode in which the electron beam is focused on a central portion of the phosphor screen, such a voltage to the additional electrode as to substantially equalize a potential distribution on a center axis of the electron beam passage hole to that of a bi-potential electron lens formed by the focus electrode and the anode.

3. The cathode-ray tube apparatus according to claim 1, wherein the voltage applying means applies the voltage to the additional electrode via a voltage-dividing resistor for dividing the anode voltage applied to the anode.

4. The cathode-ray tube apparatus according to claim 1, wherein said at least one auxiliary lens comprises a first electrode, a second electrode and a third electrode which are successively arranged in the direction of travel of the electron beam, the additional electrode and the second electrode are electrically connected, and the first electrode and the third electrode are electrically connected, and the first and third electrodes are supplied with a dynamic voltage varying in accordance with an increase in deflection amount of the electron beam.

5. The cathode-ray tube apparatus according to claim 1, wherein the additional electrode comprises a plate-shaped electrode with a horizontally elongated electron beam passage hole having a major axis in the horizontal direction.

6. The cathode-ray tube apparatus according to claim 1, wherein the main lens includes a quadrupole lens having a focusing action in a horizontal direction and a diverging action in a vertical direction in accordance with the deflection of the electron beam.

7. The cathode-ray tube apparatus according to claim 1, wherein the at least one auxiliary lens has a focusing action in horizontal and vertical directions.

8. A cathode-ray tube apparatus comprising:

an electron gun assembly having an electron beam generating unit for generating an electron beam, at least one auxiliary lens for prefocusing the electron beam generated from the electron beam generating unit, and a main lens for focusing the electron beam prefocused by the auxiliary lens on a phosphor screen; and a deflection yoke configured to generate deflection magnetic fields for horizontally and vertically deflecting the electron beam emitted from the electron gun assembly, wherein the electron gun assembly comprises a focus electrode, at least one additional electrode and an anode, which are arranged in a direction of travel of the electron beam and constitute said main lens, and also comprises a voltage applying unit configured to apply predetermined voltages to the respective electrodes constituting the main lens, the voltage applying unit applies a constant focus voltage to the focus electrode, a constant anode voltage, which is higher than the focus voltage, to the anode, and a voltage, which is higher than the focus voltage and lower than the anode voltage and varies in accordance with a deflection of the electrode beam, to the additional electrode, the potential difference between the focus electrode and anode constituting the main lens is constant regardless of the deflection amount of the electron beam, and the main lens varies such that a vertical focusing power becomes lower than a horizontal focusing power in accordance with an increase in the deflection amount of the electron beam, and said at least one auxiliary lens has a focusing power decreasing in accordance with an increase in the deflection amount of the electron beam.

9. The cathode-ray tube apparatus according to claim 8, wherein each of the electrodes constituting the main lens has an electron beam passage hole for passing the electron beam, and the voltage applying unit applies, in a non-deflection mode in which the electron beam is focused on a central portion of the phosphor screen, such a voltage to the additional electrode as to substantially equalize a potential distribution on a center axis of the electron beam passage hole to that of a bi-potential electron lens formed by the focus electrode and the anode.

10. The cathode-ray tube apparatus according to claim 8, wherein the voltage applying unit applies the voltage to the additional electrode via a voltage-dividing resistor for dividing the anode voltage applied to the anode.

11. The cathode-ray tube apparatus according to claim 8, wherein said at least one auxiliary lens comprises a first electrode, a second electrode and a third electrode which are successively arranged in the direction of travel of the electron beam, the additional electrode and the second electrode are electrically connected, and the first electrode and the third electrode are electrically connected, and the first and third electrodes are supplied with a dynamic voltage varying in accordance with an increase in deflection amount of the electron beam.

12. The cathode-ray tube apparatus according to claim 8, wherein the additional electrode comprises a plate-shaped electrode with a horizontally elongated electron beam passage hole having a major axis in the horizontal direction.

13. The cathode-ray tube apparatus according to claim 8, wherein the main lens includes a quadrupole lens having a focusing action in a horizontal direction and a diverging action in a vertical direction in accordance with the deflection of the electron beam.

14. The cathode-ray tube apparatus according to claim 8, wherein the at least one auxiliary lens has a focusing action in horizontal and vertical directions.

* * * * *